US008393290B2

(12) United States Patent
Homquist

(10) Patent No.: US 8,393,290 B2
(45) Date of Patent: Mar. 12, 2013

(54) AUTOMATED SURFACE TREATMENT SYSTEM AND METHOD

(75) Inventor: Marlon E. Homquist, Gibbon, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 443 days.

(21) Appl. No.: 12/657,109

(22) Filed: Jan. 12, 2010

(65) Prior Publication Data

US 2010/0215870 A1 Aug. 26, 2010

Related U.S. Application Data

(60) Provisional application No. 61/206,329, filed on Jan. 27, 2009.

(51) Int. Cl.
*B05C 5/02* (2006.01)
*B05C 9/14* (2006.01)

(52) U.S. Cl. ..... 118/66; 118/308; 118/324; 118/500; 118/641; 118/642; 118/643; 198/817; 198/468.9; 198/867.08

(58) Field of Classification Search ..... 118/66, 118/308, 324, 500, 641–643, 629; 198/469.1, 198/473.1, 487.1, 339.1, 346.1, 432, 867.09, 198/867.12, 817, 468.9, 867.08; 271/193; 34/617

See application file for complete search history.

(56) References Cited

U.S. PATENT DOCUMENTS

| | | | | |
|---|---|---|---|---|
| 3,902,455 | A | 9/1975 | Lehmann et al. | |
| 4,009,301 | A | 2/1977 | Heckman et al. | |
| 4,901,666 | A * | 2/1990 | Nagasaka et al. | 118/634 |
| 5,136,971 | A | 8/1992 | Blankemeyer et al. | |
| 5,620,518 | A | 4/1997 | Salisbury | |
| 5,769,949 | A | 6/1998 | Cienkus et al. | |
| 6,558,468 | B2 | 5/2003 | Masaki et al. | |
| 6,902,051 | B2 | 6/2005 | Dehne et al. | |
| 7,051,670 | B2 * | 5/2006 | Santandrea et al. | 118/50.1 |
| 7,192,624 | B2 | 3/2007 | Shtikan et al. | |
| 7,365,287 | B1 | 4/2008 | Ellis | |
| 2003/0211252 | A1 | 11/2003 | Daniels | |
| 2005/0170101 | A1 * | 8/2005 | Ramsey | 427/487 |

OTHER PUBLICATIONS

ITW BGK Electric Infrared Curing Solutions; Rev 0; dated Mar. 2005; 2 pgs.
Global Finishing Solutions, Powder Booths; dated Sep. 25, 2007; 6 pgs.
Global Finishing Solutions, Ovens ISO Dynamic & Recirculating; dated 2004; 2 pgs.
ITW BGK Finishing Systems: Electric Infrared Curing Solutions; dated 2004; 1 pg.

* cited by examiner

*Primary Examiner* — Laura Edwards
(74) *Attorney, Agent, or Firm* — Merchant & Gould P.C.

(57) ABSTRACT

This disclosure relates to systems and associated methods for applying a surface treatment to a part and curing the surface treatment without reorienting the part in the process. The systems include a first conveyor, a second conveyor, a system for applying a surface treatment, such as a powder coating application system, and a system for curing the surface treatment.

8 Claims, 9 Drawing Sheets

AUTOMATED SURFACE TREATMENT SYSTEM AND METHOD

CROSS-REFERENCE TO RELATED APPLICATIONS

This application claims the benefit of U.S. Provisional Application No. 61/206,329, filed Jan. 27, 2009; which application is incorporated herein by reference.

TECHNICAL FIELD

This disclosure relates to a system and method for surface treating one-or more parts. In particular, this disclosure relates to a conveyor-based system and method for surface treating (e.g., powder coating) one or more parts.

BACKGROUND

Electrostatic spray powder coating processes have been used in commercial and industrial applications for some time. In general, powder coating involves electrically grounding a part, spraying the part with a powder coating that has been positively charged, and then thermally curing the powder coating at elevated temperatures.

In some powder coating processes, parts are manually hung onto an overhead conveyor system. The parts are then conveyed through the various cleaning, powder coating, and curing stages of the powder coating process. Because the parts are hanging vertically, the paint or coating deposits tend to be heavier toward the lower end of the part. This uneven distribution is due at least in part to gravitational issues associated with airborne power paint, for example, settling lower in the paint booth. Uneven distribution can result in the parts having areas with too thin of a powder coating or too thick of a powder coating.

In general, such surface treatment processes and systems can be improved.

SUMMARY OF THE DISCLOSURE

One aspect of the present disclosure relates to a method of surface treating a part. The method includes applying a surface treatment to the part. The part is then conveyed on a first conveyor through a first heating system, the first conveyor contacting the part such that a first portion is exposed. The first heating system at least partially cures the surface treatment applied to the first portion of the part. The part is then automatically transferred to a second conveyor. The second conveyor supports the part by contacting the first portion of the part. The part is then conveyed by the second conveyor through a second heating system at which the entire part is fully cured.

Another aspect of the present disclosure relates to a conveyor system arranged and configured to convey surface-treated parts in accordance with the above method. Still another aspect of the present disclosure relates to a powder coating system that incorporates the features of the above method and conveyor system.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

The present disclosure includes methods and one or more systems that can be utilized in powder coating and other surface treatment applications. Generally, in the present system, parts are placed either manually or in an automated fashion on a conveyor system which conveys the parts through a powder coating process, for example. Because the parts are placed or set upon the conveyor system, the present conveyor system more easily facilitates the automation of such placement of parts, unlike conventional systems where the labor intensive process of vertically hanging parts is difficult to automate. Likewise, and as can be understood, the present system also more easily facilitates the automation of the removal of treated parts from the conveyor system.

The present conveyor system further permits parts to be placed upon the conveyor system, for example, horizontally, as opposed to being hung vertically, to allow a paint coating to settle onto the parts in a more uniform manner. As will be described in further detail hereinafter, the present conveying system and method aids in providing a more evenly distributed surface treatment to a part. Effecting a more uniform coating of a part not only improves the resulting process quality, but also reduces manufacturing costs of the coating process by utilizing less paint or coating deposits during the process.

Figure 9:
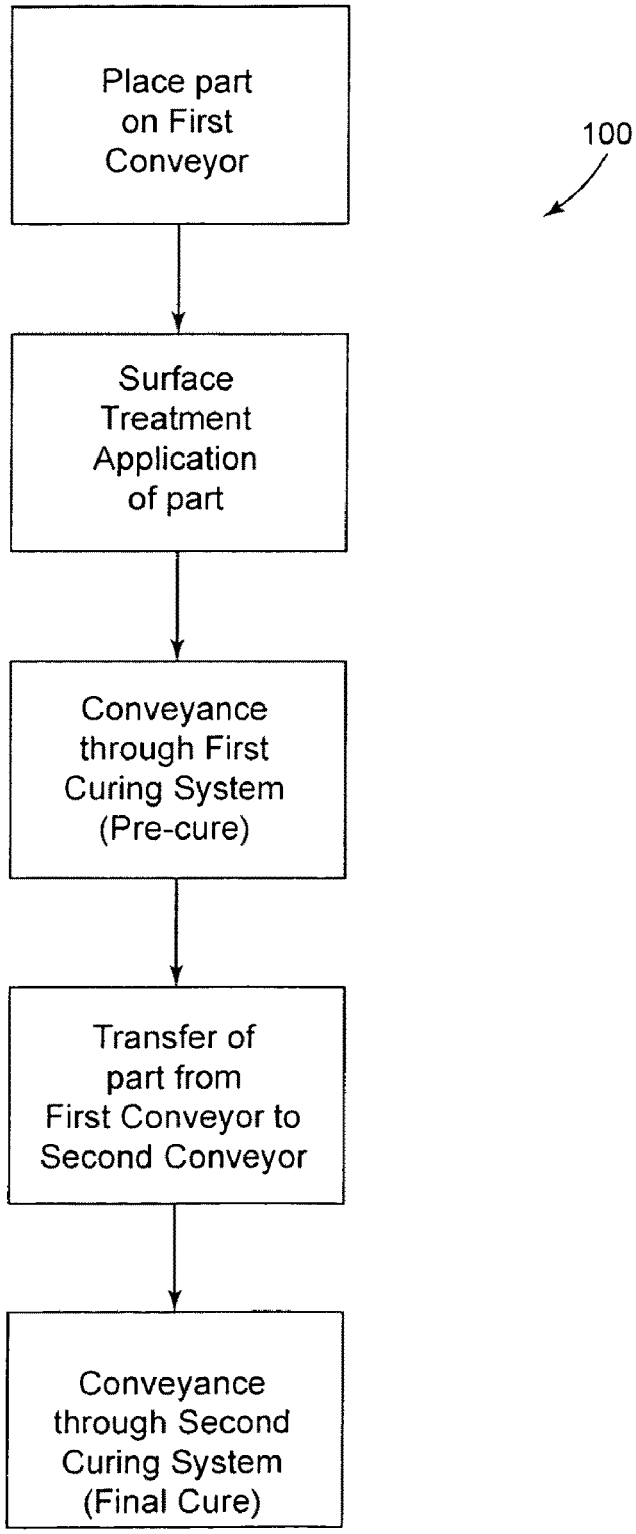
FIG. 9 is a diagrammatic representation of one embodiment of a powder coating system, in accordance with the principles disclosed.

In the presently described conveyor system, parts are conveyed through a process by the use of two conveyors, wherein the parts are automatically transferred from a first conveyor to a second conveyor. In general and referring to FIG. 9, in one exemplary powder coating system 100, the part is placed upon the first conveyor, and a surface treatment or coating is applied to the part. As previously mentioned, the present conveyor system allows the part to be place upon and carried by the conveyors in a number of selected orientations, including for example, a horizontal orientation. Accordingly, the part can be placed upon the first conveyor so that a majority of the surface area to be treated is at a common level and oriented such that the airborne deposits of the coating settle onto the part in a uniform manner.

While on the first conveyor and after applying the surface treatment, the surface treatment or coating of a first portion of the part is at least partially cured. In one embodiment, the first portion of the part is defined by a central area on one side of the part; the first portion could also include, for example, two strips that extend along the one side of the part. During this partial curing step, other portions of the part may also be partly cured, depending upon the heating system utilized in this first partial curing step.

After the first portion is at least partially cured, the part is transferred from the first conveyor to the second conveyor. While on the second conveyor, the surface treatment or coating of the entire part is fully cured.

Figure 10:
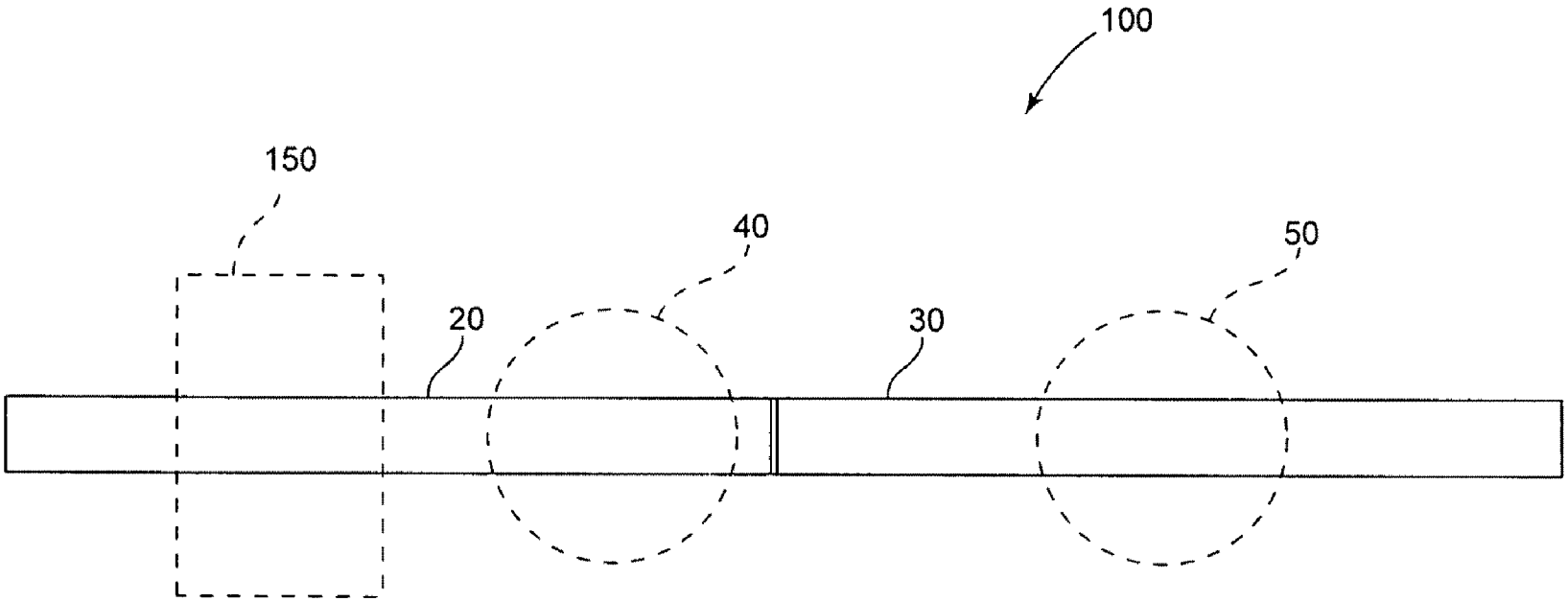
FIG. 10 is a schematic representation of the powder coating system of FIG. 9.

Referring now to FIGS. 1-6, an example embodiment of the conveyor system 10 of this disclosure is shown. The conveyor system 10 includes a first conveyor 20 and a second conveyor 30. The conveyor system 10 in this embodiment is part of a powder coating system, such as the power coating system 100 represented diagrammatically in FIG. 9. During use of the powder coating system (e.g., 100), the first conveyor 20 transports a part or a plurality of parts through a surface treatment system 150 (schematically represented in FIG. 10) at which a surface treatment or coating is applied.

Referring still to FIGS. 1-6, many different configurations of the first conveyor 20 are possible and useful. In the example embodiment illustrated, the first conveyor 20 includes support legs 21 which are connected to and support a frame 22. The frame 22 supports a first track 23 and a second track 26. The first track 23 supports a first endless chain 24 which has a plurality of support pins 25. The second track 26 supports a second endless chain 27 which has a plurality of support pins 28. Note that the endless chains 24, 27 and support pins 25, 28 are only partially shown in FIGS. 1-6 for the purpose of clarity.

Figure 1:
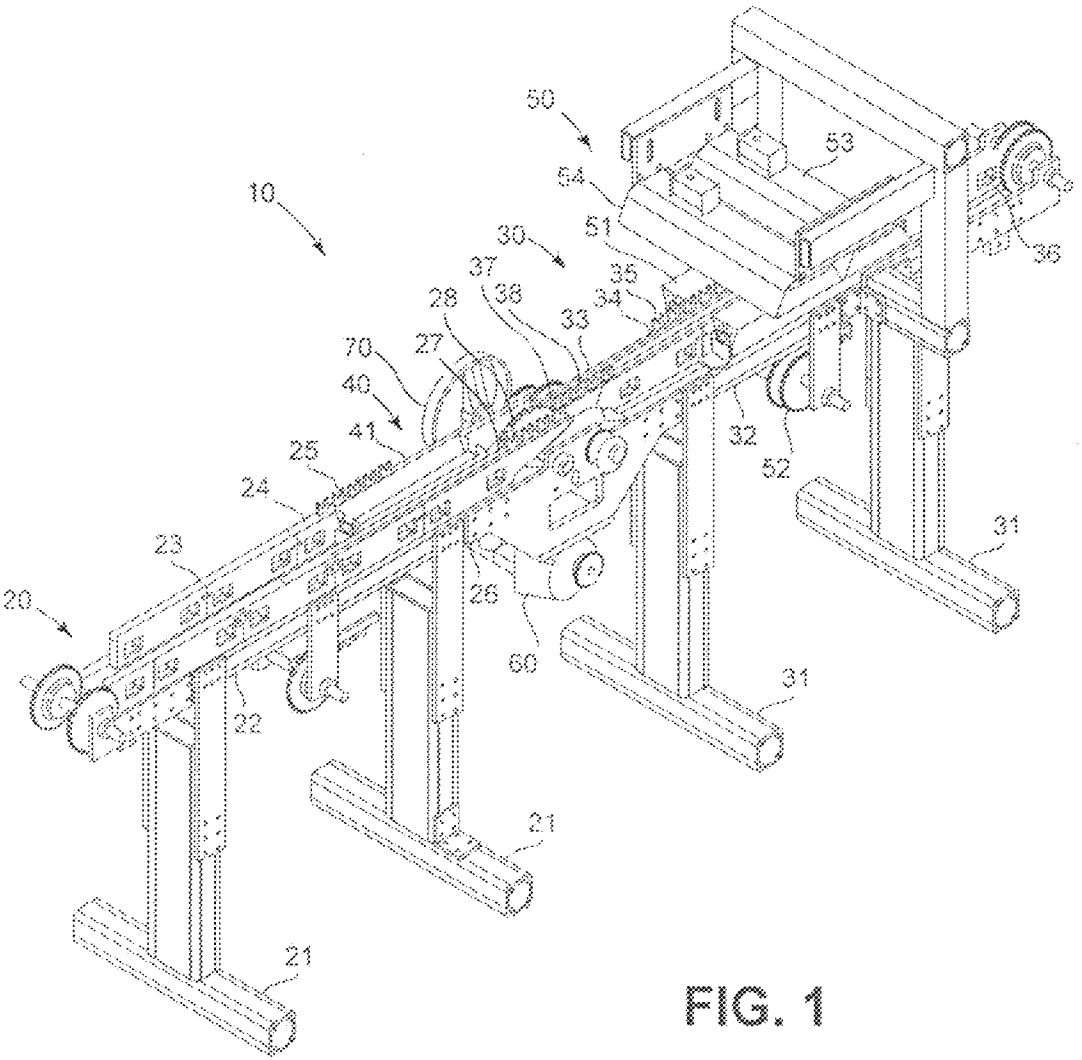
FIG. 1 is a perspective view of one embodiment of a conveyor system for use in a surface treating system, in accordance with the principles disclosed.
Figure 2:
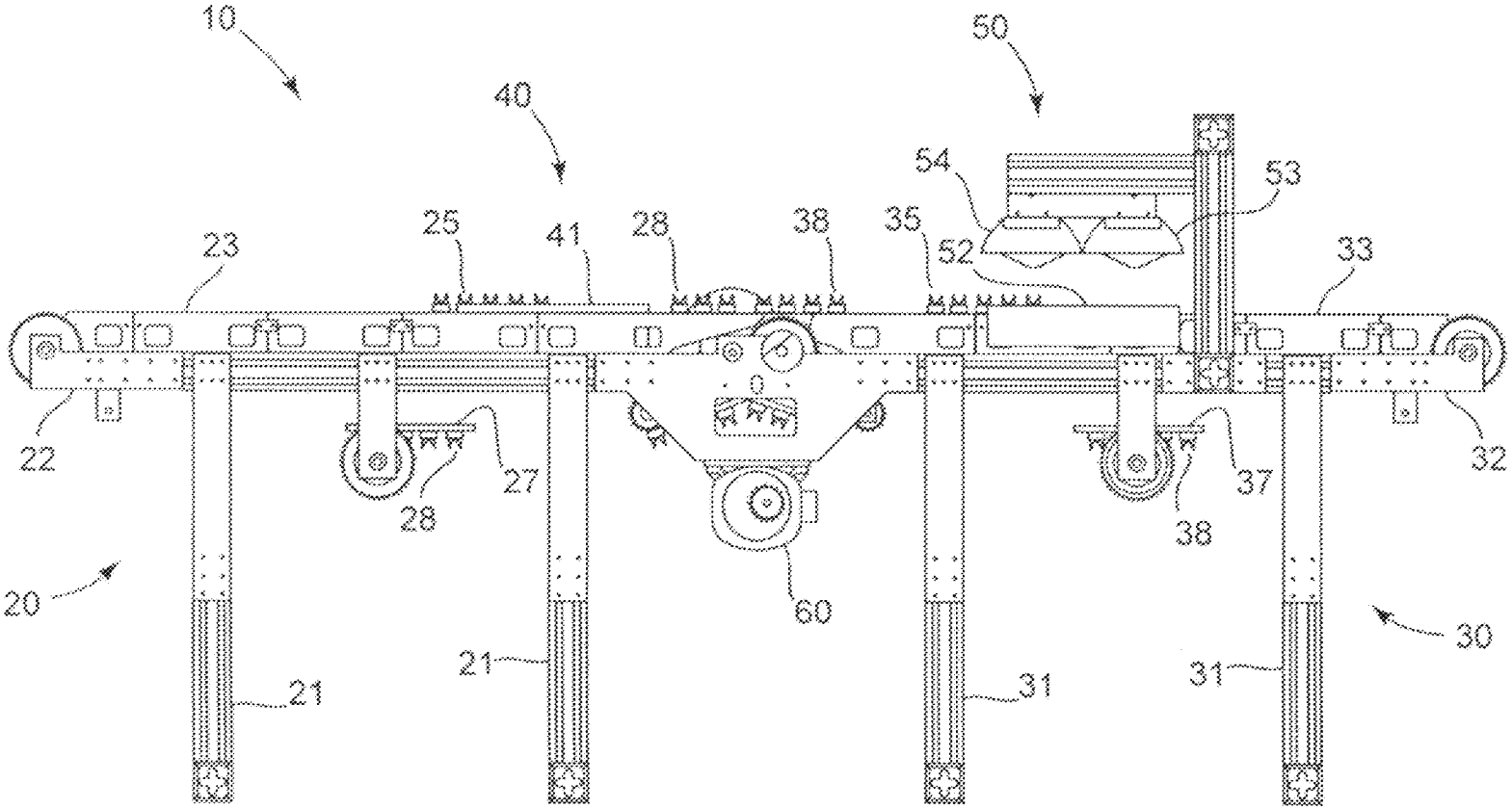
FIG. 2 is a first side view of the conveyor system of FIG. 1.
Figure 3:
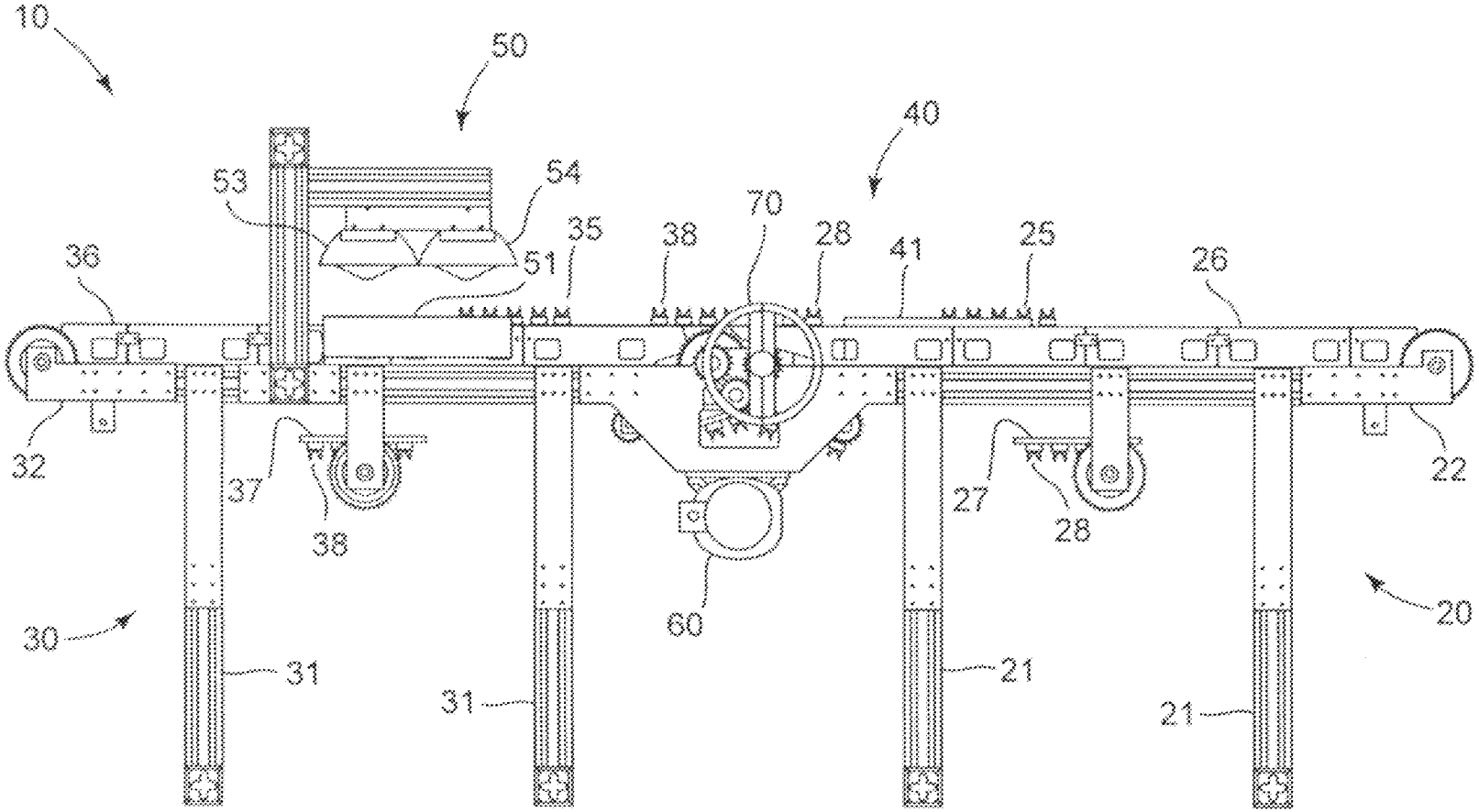
FIG. 3 is a second side view of the conveyor system of FIG. 1.
Figure 4:
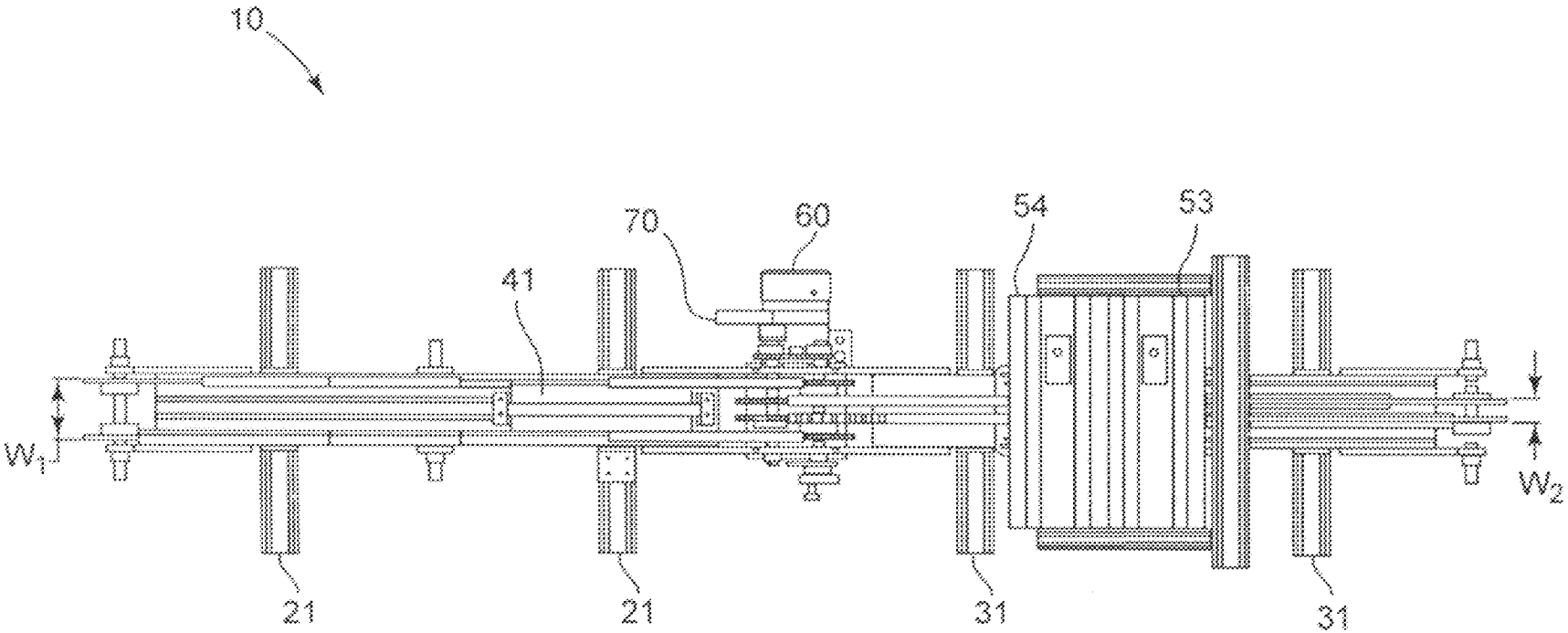
FIG. 4 is a top plan view of the conveyor system of FIG. 1.
Figure 5:
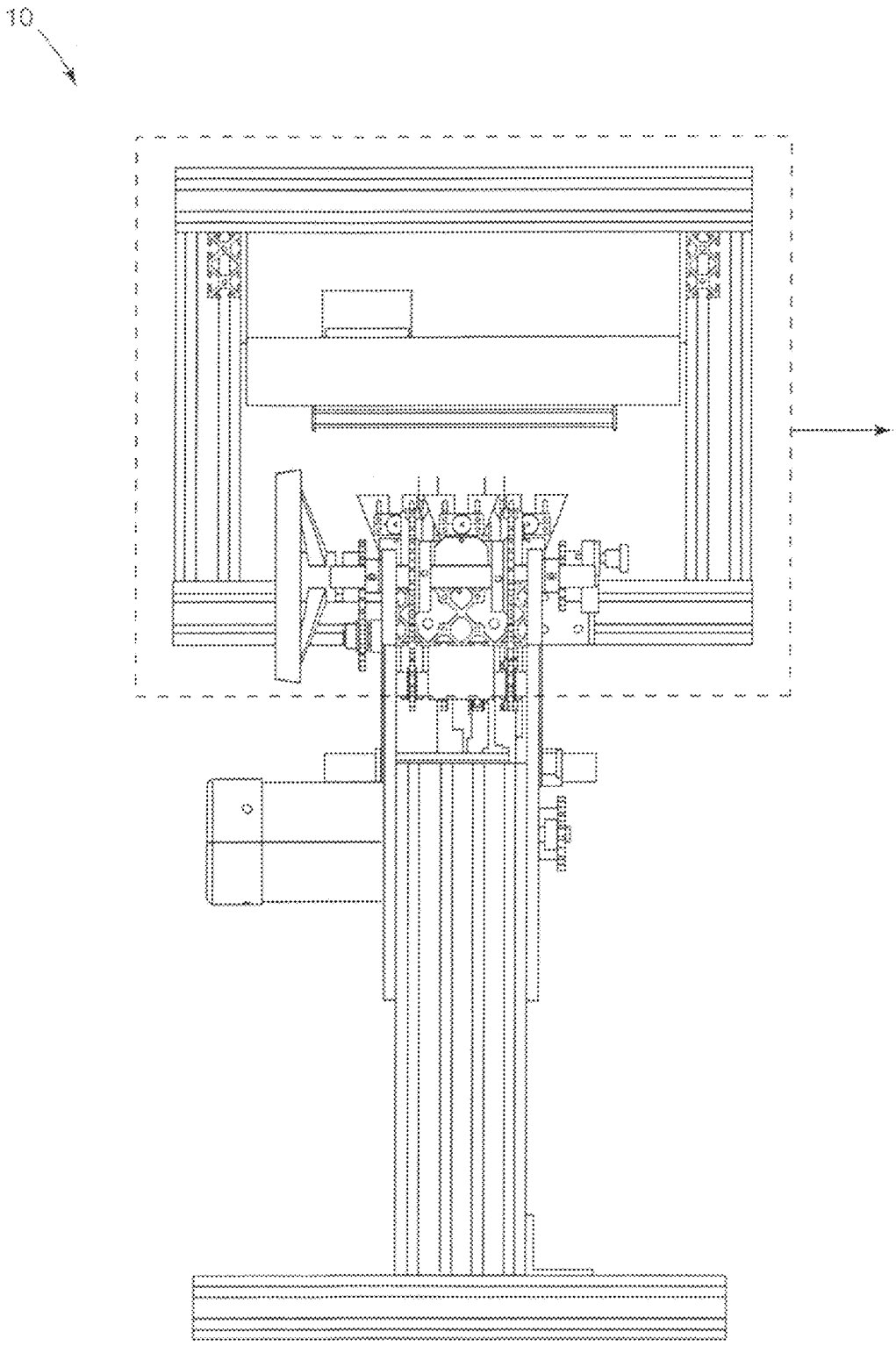
FIG. 5 is a front elevation view of the conveyor system of FIG. 1.
Figure 6:
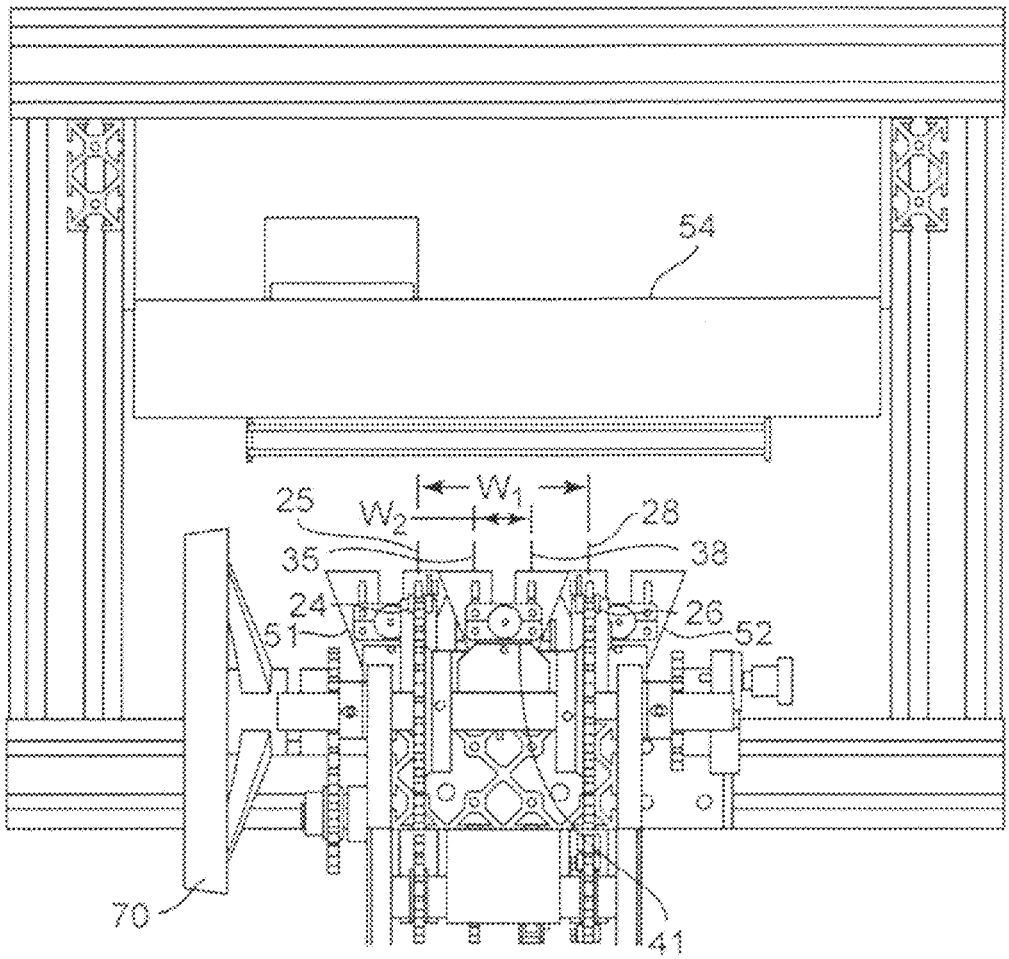
FIG. 6 is an enlarged detail view of a portion of the conveyor system of FIG. 5.
Figure 7:
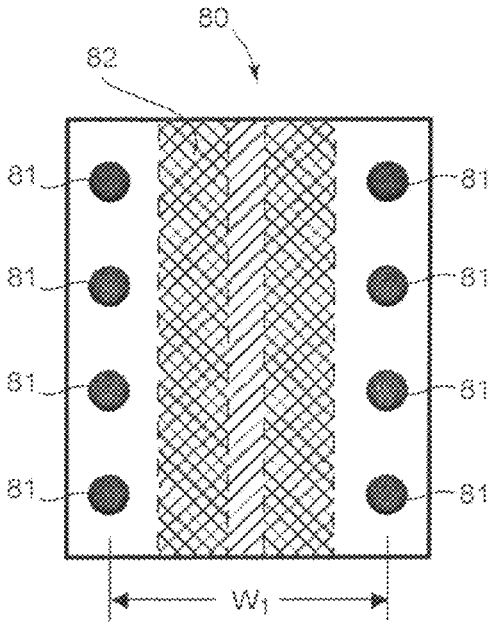
FIG. 7 is a schematic representation of a part being conveyed by a first conveyor of the conveyor system of FIG. 1.

The endless chains 24, 27 slide or move along the first and second tracks 23, 26 respectively and are driven by gears via a drive motor 60 or manually via a drive wheel 70. The support pins 25, 28, which are separated by a first width $W_1$ (FIG. 7), support a part 80 (FIG. 7) and form a first conveying surface. Referring to FIG. 7, the portion of each part 80 in surface contact with the support pins 25, 28 is referred to as a first contact area 81 (illustrated schematically).

One exposed portion of the part not in contact with the first conveyor 20 is referred to as a first portion 82 of the part (illustrated schematically in FIG. 7). What is meant by "exposed" is that no portion of the conveyor contacts that particular portion of the part 80 during transport by that conveyor. The first portion 82 includes and/or defines a second contact area 83 (FIG. 8), which is discussed in greater detail hereinafter. As previously described, the first portion 82 may include an area of one side of the part, or two strips along the part, but includes and/or defines at least the second contact area 83 of the part. In one system, during the application of the surface treatment on the first conveyor 20, the entire part, including the first portion 82 of the part is coated, such as with a powder coating, for example. In one embodiment, the support pins 25, 28 may be in conductive contact with each part thereby providing the necessary grounding in a powder coating application.

The second conveyor 30 of the present conveyor system 10 receives the part or parts automatically from the first conveyor 20 without reorienting the part. What is meant by "automatically" is that the first conveyor 20 transfers the part to the second conveyor 30 without intermediate handling; i.e., the conveyance of the part is continuous from one conveyor to the other. Many different configurations of the second conveyor 30 are possible and useful. In the example embodiment illustrated, the second conveyor 30 includes support legs 31 which are connected to and support a frame 32. The support frame 32 supports a first track 33 and a second track 36. The first track 33 supports a first endless chain 34 which has a plurality of support pins 35. The second track 36 supports a second endless chain 37 which has a plurality of support pins 38. Note that the endless chains 34, 37 and the support pins 35, 38 are only partially shown in FIGS. 1-6 for the purpose of clarity.

The endless chains 34, 37 slide along or move the first and second tracks 33, 36 respectively and are driven by gears via the drive motor 60 or manually via the drive wheel 70. The support pins 35, 38, separated by a second width $W_2$ (FIG. 8) that is less than the first width $W_1$ (FIG. 7) of the first conveyor 20, support the part and form a second conveying surface. The portion of the part in surface contact with the support pins 35 and 38 is referred to as the second contact area 83 (illustrated schematically in FIG. 8). In one embodiment, the support pins 35, 38 are in conductive contact with each part to provide any needed grounding.

Figure 8:
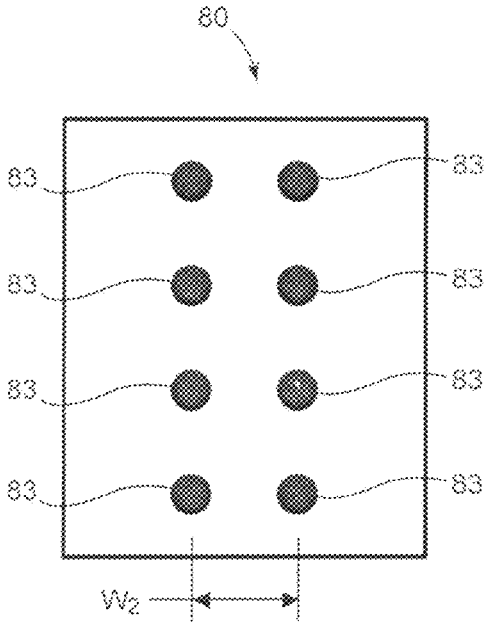
FIG. 8 is a schematic representation of a part being conveyed by a second conveyor of the conveyor system of FIG. 1.

Referring to FIGS. 7 and 8, the second contact area 83 is non-overlapping with the first contact area 81 and is overlapping with the first portion 82 of the part. One skilled in the art will appreciate that the second width $W_2$ of the second conveyor 30 may also be greater than or equal to the first width $W_1$ of the first conveyor 20 while still maintaining the overlapping and non-overlapping relationships between the contact areas and the first portion of the part.

The powder coating system of the present disclosure (e.g., 100, FIG. 9) further includes a first curing system 40 (FIG. 2) and a second curing system 50. The first curing or heating system 40 can be utilized in a process where the entire surface area of the part is at least partially cured, or where only a portion or portions, including the first portion 82 of the part is at least partially cured. The first curing system 40 may also be used to fully cure the surface treatment of only a portion of the part, including the first portion of the part. In this particular powder coating system, the first curing system 40 is located between the support pins 25, 28 of the first conveyor 20. Curing the surface treatment on the portion of each part (e.g., portion 82) between the support pins 25, 28 is beneficial so as to allow each part to later be supported at this area (i.e., the second contact area 83). In one method, the partial cure sufficiently hardens the treatment or coating such that the coating does not re-melt during further curing and such that the pins of the second conveyor do not damage the finish when contacting or supporting the part through the second curing system.

Many different configurations of the first curing system 40 are possible and useful. In the embodiment shown, the curing system 40 includes a first lower heater 41 that is directed upwards toward the conveyed parts. In one application, the first lower heater 41 is an electric infrared strip heater having an electric heating element and a reflector. It is to be appreciated, however, that many other types of heaters capable of curing or partially curing a surface treatment may be used.

The second curing or heating system 50 is arranged for use in fully curing the part, including any portion of the surface treatment only partially cured by the first curing system 40. Also, as previously described, the surface treatment can be applied to the part while the part is supported by the first conveyor 20. The first contact area 81 between the part 80 and the first conveyor 20 may not be coated, as this area may be covered by the support pins 25, 28. Given the "pin" contact however between the first conveyor and the part, the coating distributes into the first contact area 81 during this second full curing step (as the "pin" point areas of the first conveyor are relatively small in size and are now exposed). That is, the coating melts or liquidizes and flows over the first contact area 81 to cover the "pin" point contacts during the final curing step on the second conveyor 30.

Likewise, the previous partially cured portion (e.g., 82), which is now in contact with the support pins 35, 38 of the second conveyor is also fully cured; the full curing being provided in part by the "pin" contact of the support pins. In particular, the reduced area of the "pin" contact permits the coating to more freely flow. This "pin" contact, in combination with the previous, partial curement of the area, provides for a more evenly distributed cured coating in this contact area 83.

Many different configurations of the second curing system 50 are possible and useful. In the example embodiment illustrated, the second curing system 50 includes a first lower heater 51, a second lower heater 52, a first upper heater 53, and a second upper heater 54. The first and second lower heaters 51, 52 are located on either side of the first and second support pins 35, 38 and direct heat upwards toward each part. The first and second upper heaters are located above the support pins 35, 38 and direct heat downwards toward each part. In one application, the lower heaters 51, 52 and the upper heaters 53, 54 are electric infrared type strip heaters having electric heating elements and reflectors. It is to be appreciated, however, that many other types of heaters capable of curing a surface treatment may be used.

As previously described, the exemplary powder coating system 100 (FIG. 9) includes a surface treatment system 150 (schematically represented in FIG. 10) for applying the surface treatment to the part or the plurality of parts. Many types of spraying systems are useful for this purpose. In the system illustrated in FIG. 10, during conveyance on the first conveyor 20, the surface treatment system 150 applies the surface treatment to the part. In the alternative, the surface treatment can be applied prior to placing the part on the first conveyor 20.

In general, the present disclosure relates to a method of conveying and surface treating a part. The method includes applying the surface treatment to the part; at least partially curing the surface treatment of the part, or at least a portion of the part; automatically transferring the part from the first conveyor to a second conveyor without reorienting the part, and fully curing the entire part.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

What is claimed is:

1. A powder coating system for powder coating treatment of a part, the powder coating system comprising:

(a) a powder coating application system;

(b) first and second heating systems, wherein the first heating system at least partially cures a powder coating applied to the part by the application system, and wherein the second heating system fully cures the powder coating applied to the part by the application system; and (c) a conveying system, including:

(i) a first conveyor that conveys the part through the first heating system, the first conveyor contacting the part during conveyance such that a first portion of the part is exposed; and (ii) a second conveyor that conveys the part through the second heating system, the second conveyor contacting only the first portion of the part during conveyance;

(iii) wherein the first conveyor automatically transfers the part to the second conveyor without reorienting the part.

2. The powder coating system of claim 1, wherein the first conveyor is in conductive contact with the part during conveyance.

3. The powder coating system of claim 1, wherein the first and second heating systems comprise electric infrared heaters.

4. The powder coating system of claim 1, wherein the first and second conveyors each comprise a pair of endless chains having a plurality of support pins for supporting and conveying the part.

5. The powder coating system of claim 4, wherein the endless chains of the first and second conveyors are driven by a single motor.

6. A powder coating system for powder coating treatment of a part, the system comprising:

(a) a first conveyor including a first endless chain and a second endless chain, the endless chains including a multitude of support pins, the support pins of the first endless chain and the support pins of the second endless chain being separated by a first width, the support pins conductively contacting the part such that a first portion of the part is exposed;

(b) a second conveyor including a first endless chain and a second endless chain, the endless chains including a multitude of support pins, the support pins of the first endless chain and the support pins of the second endless chain being separated by a second width different than the first width of the first conveyor, the support pins conductively contacting the part only within the first portion of the part;

(c) a powder coating application system that applies a powder coating to the part while on the first conveyor;

(d) first and second heating systems that cure the powder coating applied to the part by the powder coating application system;

(e) wherein the first conveyor transports the part through the first heating system, and the second conveyor transports the part through the second heating system, and wherein the first conveyor automatically transfers the part to the second conveyor without reorienting the part.

7. A system that transports a part in a surface treatment application, the system comprising:

a conveying system including:

(i) a first conveyor that conveys the part, wherein a first conveying surface contacts a first contact area of the part during conveyance;

(ii) a second conveyor that conveys the part, wherein a second conveying surface contacts a second contact area of the part during conveyance, the second contact area being non-overlapping with the first contact area;

(iii) wherein the first conveyor automatically transfers the part to the second conveyor without reorienting the part;

(iv) a surface treatment system, the surface treatment system applying a surface treatment to the part while on the first conveyor;

(v) wherein at least the first conveying surface is in conductive contact with the part during conveyance;

(vi) a first heater for at least partially curing the surface treatment; and (vii) a second heater for fully curing the surface treatment.

8. The conveying system of claim 7, wherein:

(a) the first conveyor includes a first endless chain and a second endless chain, the endless chains including a multitude of support pins, the support pins of the first endless chain and the support pins of the second endless chain being separated by a first width, wherein the support pins are in surface contact with the part and define the first conveying surface; and (b) the second conveyor includes a first endless chain and a second endless chain, the endless chains including a multitude of support pins, the support pins of the first endless chain and the support pins of the second endless chain being separated by a second width different than the first width of the first conveyor, wherein the support pins are in surface contact with the part and define the second conveying surface.

* * * * *

UNITED STATES PATENT AND TRADEMARK OFFICE

CERTIFICATE OF CORRECTION

PATENT NO. : 8,393,290 B2
APPLICATION NO. : 12/657109
DATED : March 12, 2013
INVENTOR(S) : Holmquist It is certified that error appears in the above-identified patent and that said Letters Patent is hereby corrected as shown below:

Title page, (75) Inventor: "Homquist," should read --Holmquist,--

Signed and Sealed this
Twentieth Day of August, 2013

Teresa Stanek Rea
*Acting Director of the United States Patent and Trademark Office*